US005673907A

United States Patent [19]

Rumsey et al.

[11] Patent Number: 5,673,907

[45] Date of Patent: *Oct. 7, 1997

[54] MISFEED DETECTOR FOR MULTI TRAY SHEET FEEDERS

[75] Inventors: Michael D. Rumsey, Redondo Beach; William D. Bartron, Rancho Palos Verdes; Keith Johnson, El Segundo, all of Calif.

[73] Assignee: Xerox Corporation, Stamford, Conn.

[ * ] Notice: The term of this patent shall not extend beyond the expiration date of Pat. No. 5,503,382.

[21] Appl. No.: 387,673

[22] Filed: Feb. 13, 1995

[51] Int. Cl.[6] ..... B65H 3/44; B65H 5/26

[52] U.S. Cl. ..... 271/9.13; 271/10.03; 271/258.01; 271/263

[58] Field of Search ..... 271/9.01, 9.05, 271/9.13, 3.03, 3.13, 10.03, 110, 111, 258.01, 259, 262, 263, 265.04

[56] References Cited

U.S. PATENT DOCUMENTS

| | | | |
|---|---|---|---|
| 4,651,982 | 3/1987 | Martin | 271/263 |
| 4,881,104 | 11/1989 | Kusumoto et al. | 271/9.05 |
| 5,110,114 | 5/1992 | Yamauchi et al. | 271/263 |
| 5,114,138 | 5/1992 | Ichinoje | 271/263 |
| 5,135,114 | 8/1992 | Satake et al. | 209/588 |
| 5,503,382 | 4/1996 | Hanson et al. | 271/9.13 |
| 5,586,755 | 12/1996 | Hanson | 271/9.06 |

FOREIGN PATENT DOCUMENTS

| | | | |
|---|---|---|---|
| 0195105 | 9/1986 | European Pat. Off. | 271/262 |
| 62-116441 | 5/1987 | Japan | 271/263 |
| 0117542 | 5/1990 | Japan | 271/262 |
| 0144353 | 6/1990 | Japan | 271/262 |

*Primary Examiner*—H. Grant Skaggs
*Attorney, Agent, or Firm*—Sheldon F. Raizes

[57] ABSTRACT

The invention relates to an apparatus for detecting sheet misfeed from a multi-tray sheet feeder. The thickness of the first sheet fed from each tray is detected by a common sensor and a thickness value is placed in memory for that tray. Each sheet subsequently fed from the same tray is detected by the common sensor and the thickness value sensed is compared with the thickness value in memory for that tray. If the values match, then only one sheet has been fed from the tray. If the thickness value is more that the thickness value in memory for that tray, then that indicates that more than one sheet has left the tray and the system is shut down to enable an operator to correct the situation. When a tray is reloaded, the thickness value in memory for the sheets previously loaded in the tray is erased and the first sheet fed from the reloaded tray is sensed and a thickness value for that sheet is placed in memory for the reloaded tray.

4 Claims, 5 Drawing Sheets

MISFEED DETECTOR FOR MULTI TRAY SHEET FEEDERS

This application is related to U.S. application Ser. No. 08/387,672, entitled Misfeed Detector For Multi-Tray And Intermediate Tray Sheet Feeders, filed Feb. 13, 195, now U.S. Pat. No. 5,503,382, and to U.S. application Ser. No. 08/387,678, entitled Misfeed Detector For A Stack Of Different Weight Sheets, filed Feb. 13, 1995 and now U.S. Pat. No. 5,506,755. Each of these applications is assigned to the assignee of this application.

BACKGROUND

This invention relates to a system for detecting a multi-sheet feed from paper trays.

It is common to employ a multi-tray sheet feeder with laser printers. The sheets are fed from the multi-tray sheet feeder to a printer. It is important that only one sheet at a time be fed from each tray and if more than one sheet is fed from a tray, that it be detected immediately and the system can be either shut down to correct the situation or the offending sheets can be sent to a purge tray at the printer without shutting down the system. The sheets in one tray of the multi tray sheet feeder may be of a thickness which is different than the thickness of the sheets in another tray of the multi tray sheet feeder. Therefore, there must be a way of detecting a double sheet feed while still acknowledging that sheets in one tray may be of a thickness that is different from the sheets in the other trays.

SUMMARY OF INVENTION

In accordance with this invention, the thickness of the first sheet fed from a tray is detected by a sensor and a thickness value is placed in memory for that tray. Each sheet subsequently fed from the same tray is detected by the same sensor and the thickness value sensed is compared with the thickness value in memory for that tray. If the values match, then only one sheet has been fed from the tray. If the thickness value is more that the thickness value in memory for that tray, then that indicates that more than one sheet has just left the tray and the system is shut down to enable an operator to correct the situation. When a tray is reloaded, the thickness value in memory for the sheets previously loaded in the tray is erased and the first sheet fed from the reloaded tray is sensed and a thickness value for that sheet is placed in memory for the reloaded tray.

DETAILED DESCRIPTION OF THE INVENTION

Figure 1:
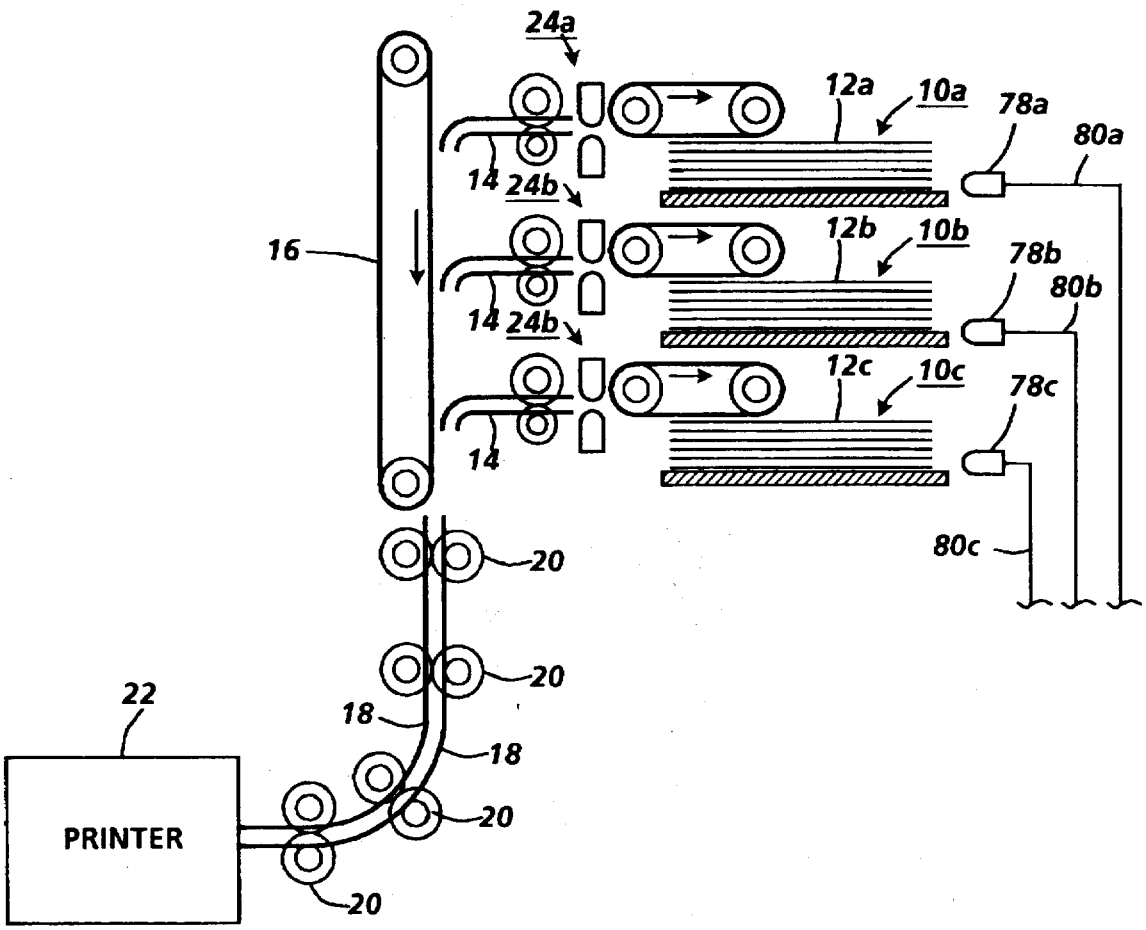
FIG. 1 is a schematic view of a printing system which includes a multi sheet feed detector of one embodiment of this invention.

Referring to FIG. 1, there is shown a printing system comprising three trays 10*a*, 10*b*, and 10*c*, each having a plurality of sheets 12*a*, 12*b*, and 12*c*, respectively, stacked therein. The sheets in each tray are of the same thickness as the others in the same tray, but may be either a different thickness than the sheets in one or more of the other trays or the same thickness as the sheets in one or more of the other trays. A sheet feeding apparatus 14 is provided for each feed tray and a common vacuum sheet transport belt conveyor 16 transports a sheet to guides 18 where a plurality of driven nip rolls 20 move a sheet through the guides from which the sheets enter a laser printer 22 where an image is transferred to each sheet. Sensors 24*a*, 24*b*, and 24*c* are located, respectively, between the trays 10*a*, 10*b*, and 10*c* and their corresponding sheet feeding apparatus 14 for sensing the thickness of the sheets 12*a*, 12*b* and 12*c* as they are fed from their respective trays.

Figure 2:
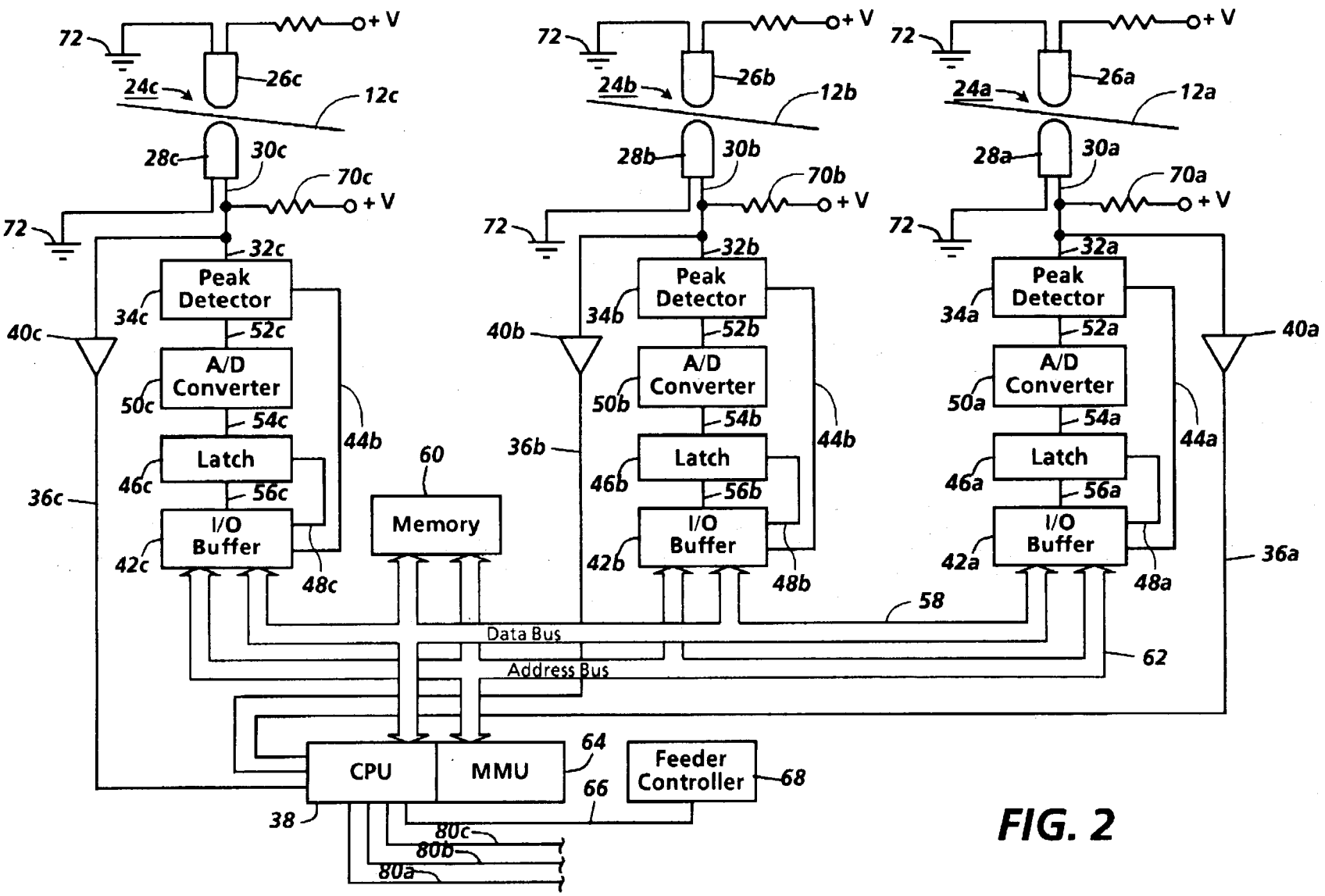
FIG. 2 is a block schematic diagram of the multi-sheet feed detector operating system illustrated in FIG. 1.

Referring to FIG. 2, there is shown a schematic of a sheet thickness sensing arrangement for each tray 10*a*, 10*b* and 10*c*. The inlet sensor 24*a* comprises an infrared emitter 26*a* and a phototransistor 28*a*. The collector 30*a* of the phototransistor 28*a* is connected through a control line 32*a* to a peak detector 34*a* and through control line 36*a* to a CPU (central processing unit) 38. A positive transition detector 40*a* is located in control line 36*a* between the phototransistor 28*a* and the CPU 38 and detects sudden voltage changes at the collector 30*a*. The peak detector 34*a* detects a peak voltage at collector 30*a* and is connected to an I/O (Input/output) buffer 42*a* through a control line 44*a* to allow the CPU to reset the peak detector to zero. A latch 46*a* is connected to the I/O buffer 42*a* through a control line 48*a* to allow the CPU to implement a data latch function. An A/D (analog/digital) converter 50*a* is connected to the peak detector 34*a* by line 52*a* and to the latch 46*a* by a 10 bit data line 54*a*. A 10 bit data line 56*a* connects the latch 46*a* to the I/O buffer 42*a*. Each of the sensors 24*b* and 24*c* have the same arrangement as described for sensor 24*a* and the elements which are the same are designated by the same reference numbers only the letters "b" and "c" are substituted for the letter "a" that is affixed to the reference numbers. A 16 bit data bus 58 links the CPU 38 with the I/O buffers 42*a*, 42*b*, 42*c* and memory 60. An address bus 62 links a MMU (memory management unit) 64 with the I/O buffers 42*a*, 42*b*, 42*c* and the memory 60.

The memory 60 is a two part memory having a RAM and an EPROM. The EPROM contains a program for controlling measurement and storage of thickness values of the sheets 12*a*, 12*b*, and 12*c* arriving at respective sensors 24*a*, 24*b*, and 24*c* from the trays 10*a*, 10*b*, and 10*c* and for comparison of the thickness values for detecting double sheet feed from each of the trays 10*a*, 10*b*, and 10*c*. The CPU 38 is connected through a control line 66 to a feeder controller 68 for controlling feeding of the sheets from the trays 10*a*, 10*b* and 10*c*.

The amount of current that flows through the phototransistors 28*a*, 28*b*, and 28*c* is a function of the amount of light to which a phototransistor is exposed. If the exposure to light is increased, more current will flow and if the exposure to light is decreased, less current will flow. The emitters 26*a*, 26*b*, and 26*c* each emits rays towards the base of its respective phototransistor 28*a*, 28*b*, and 28*c* and strikes its respective phototransistors at maximum intensity when a sheet of paper is not between the emitter and its respective phototransistor. Therefore, there is maximum current flow across a resistor 70*a*, 70*b*, and 70*c* when a sheet of paper is not between an emitter and its respective phototransistor and the voltage difference between a ground 72 and a respective collector 30*a*, 30*b*, and 30*c* of the phototransisters 28*a*, 28*b*, and 28*c* is at its lowest value in this condition. It also follows that there is maximum current flow across the resistors 70*a*, 70*b*, and 70*c* when a sheet of paper is not between the respective emitters and phototransistors and the voltage difference between ground and the collectors of the phototransisters is at its lowest value in this condition.

When a sheet of paper passes between an emitter and its respective phototransistor, light from the emitter will pass through the sheet of paper with the amount of light passing through being dependent upon the thickness of the paper. More light will pass through a thin sheet than a thick sheet. Since a phototransister is exposed to less light when a sheet of paper is passing between the emitter and the phototransister, less current flows across its respective resistor 70*a*, 70*b*, and 70*c* and the voltage difference between the respective collector 30*a*, 30*b*, and 30*c* and ground 72 increases. The voltage difference between ground and a collector will increase in accordance with an increase in the thickness of a sheet since the amount of light to which a phototransistor is exposed decreases as the thickness of a sheet sensed increases.

Figure 3:
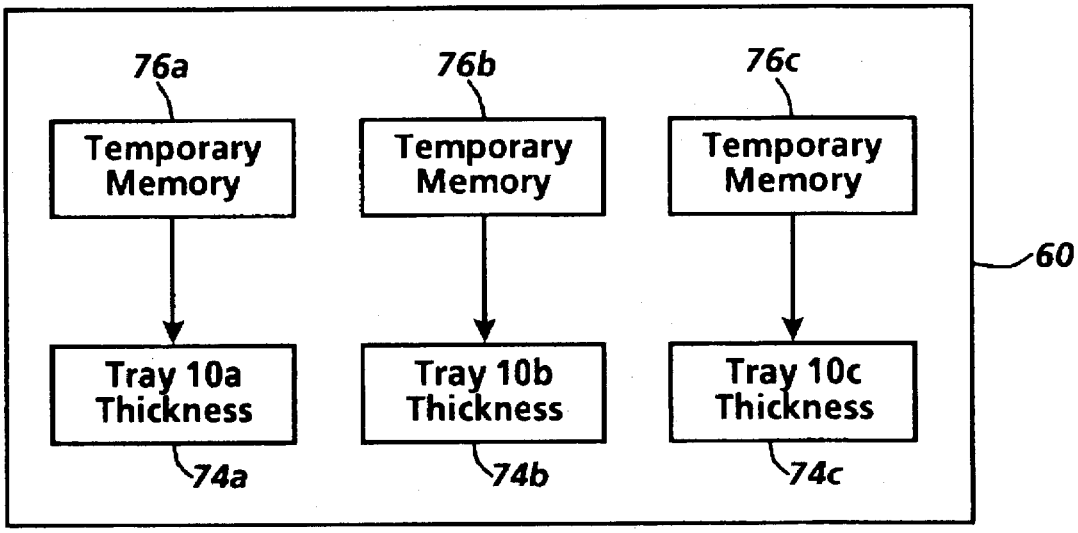
FIG. 3 is a block schematic diagram of a portion of a RAM memory of the schematic of FIG. 2.

The Ram section of the memory 60 is shown in FIG. 3. There are three memory locations 74*a*, 74*b* and 74*c* for the thickness value of the sheets in each tray 10*a*, 10*b*, and 10*c*, respectively. The sensed thickness value of the first sheet fed from a particular tray is put into these locations for the particular tray from which a first sheet is fed. There are also temporary memory locations 76*a*, 76*b*, and 76*c* for the thickness values sensed by sensors 24*a*, 24*b*, and 24*c*, respectively, of all other sheets fed from the trays.

Each tray 10*a*, 10*b*, and 10*c* has a sensor 78*a*, 78*b*, and 78*c* connected thereto for sensing when its respective tray has been lowered for refilling. The sensors 78*a*, 78*b*, and 78*c* are communicated to the CPU 38 by control lines 80*a*, 80*b*, and 80*c*, respectively. The sensor may be a contact switch, a push button switch or any other well know sensing device. When a tray is lowered, the sensor causes an interrup through a respective control line at the CPU 38. The CPU 38 is programmed to respond to the interrup to clear the memory for the tray that has been lowered and start the program for placing in the appropriate memory location for that tray the thickness value of the first sheet sensed that is fed from that tray after it is reloaded.

In operation, and referrring to only sheets being fed from tray 10*a*, when a first sheet 12*a* is fed from tray 10*a* and introduced into the sensor 24*a*, there will be a sudden voltage change at the collector 30*a* which is sensed by the positive transition detector 40*a* which causes an interrupt through the control line 36*a* at CPU 38. The CPU is programmed to only respond to the initial interrupt and ignore any subsequent interrupts until after the sheet of paper has left the sensor 24*a*. In response to the initial interrupt, the CPU, in conjunction with the MMU 64, addresses the I/O buffer 42*a* which immediately resets the peak detector 34*a*. The voltage at collector 30*a* can be sampled only once per sheet or a plurality of times as the sheet passes through the sensor. Sampling the sheet thickness once has a drawback if the sheet has a hole in it, has an opaque portion or, if it is a preprinted form, has light and dark printing on it, since, if any of these are sensed, an incorrect reading of the thickness of a sheet will occur. Therefore it is desirable to sample the thickness of the sheet at more than one location. For example, the sheet can be sampled six times as the sheet passes through the sensor 24*a*. Assuming that the sheet is 8½×11 inches and the 8½ inch edge is the leading edge into the sensor 24*a*, and the sheet passes across the sensor 24*a* at a speed of 65 inches per second, each sheet section sensed before sampling will be 1.4 inches and sampling will occur every 22 milliseconds.

The peak detector senses the voltage at collector 30*a* as the sheet passes between the emitter 26*a* and the phototransistor 28*a* with this voltage representing the thickness of the sheet. The voltage at the peak detector 34*a* is inputted to the A/D converter 50*a* in analog form and this is converted to digital form by the A/D converter 50*a* and sent to the latch 46*a*. The first sensing will be completed by a first sampling taken 22 milliseconds after entry of the sheet into the sensor 24*a*. The latch will be set at 22 milliseconds to capture the peak voltage in peak detector 34*a* and the peak detector reset immediately thereafter for detecting the voltage over the next 1.4 inches of the sheet. Some time between the expiration of the first 22 milliseconds and the expiration of the next 22 milliseconds, the I/O buffer 42*a* will send the voltage information for the first sampling of the sheet to the memory 60. The same cycle is repeated until after the sixth 1.4 inch section is sampled. When a new sheet is introduced into the sensor 24*a*, the sudden voltage change at the collector 30*a* is sensed by the positive transition detector 40*a* which causes an interrupt at the CPU 38 and the same cycle is repeated for the new sheet.

After the sixth 1.4 inch section of a sheet 12*a* is sampled while the sheet passes through sensor 24*a*, the six sampled values of the first sheet from the tray 110*a* is placed into memory location 74*a* as the thickness value for all of the remaining sheets in tray 10*a*. The thickness value sensed for all subsequent sheets fed from tray 10*a* will be compared to the thickness value in memory location 74*a*. The thickness value in memory location 74*a* will stay in memory location 74*a* until the tray 10*a* is lowered to refill the tray at which time the sensor 78*a* will cause an interrup through control line 80*a* at the CPU 38 and the current thickness value is cleared from memory location 74*a*. The thickness value sensed by sensor 24*a* of the first sheet fed from the tray 10*a*, after the tray 10*a* has been refilled and after the memory location 74*a* has been cleared, will be placed into the memory location 74*a* as the newthickness value for all of the remaining new sheets placed into tray 10*a*.

When a subsequent sheet 12*a* is fed from the tray 10*a*, it is sensed by sensor 24*a* in the same manner as the first sheet was and after the sixth 1.4 inch section of a sheet 12*a* is sampled while the sheet passes through sensor 24*a*, the six sampled values of the sheet is temporarily placed into memory location 76 and those values are compared with the six sampled values of the first sheet from the tray 10*a* that are in memory location 74*a*. This can be achieved by comparing the sum of the six sensed values in memory location 76 with the sum of the six sensed values in memory location 74*a*. If the sums are within a chosen tolerance of each other, it will be assumed that only one sheet has passed through the sensor 24*a* and normal operation of the printing system will continue. If the sum of the six sensed values, which is located in memory location 74*a*, for the first sheet is less than the sum of the six sensed values, located in memory location 76, of a subsequent sheet fed from tray 10*a* by more than a chosen tolerance, then such will indicate a greater sheet thickness for the subsequent sheet than the first sheet. Thus, it will be assumed that more than one sheet has passed through the sensor 24*a* and a signal will be sent by the CPU 38 over the control line 66 to the feeder controller 68 to immediately stop the sheet feeding system. A system operator can then remove the double fed sheets and reset the system to resume normal operation. Alternatively, a signal can cause the offending sheets to be sent to a purge tray at the printer without stopping the sheet feeding system.

When a first sheet 12*b* and 12*c* is fed from trays 10*b* or 10*c*, the sheet will be sensed by respective sensors 24*b* and 24c in the same manner as the sheet 12a is sensed by sensor 24a. The thickness value sensed by sensor 24b will be placed in memory location 74b for tray 10b as the thickness value for all of the remaining sheets in tray 10b and the thickness value sensed by sensor 24c will be placed in memory location 74c for tray 10c as the thickness value for all of the remaining sheets in tray 10c. The thickness value in memory locations 74b will stay in memory location 74b until the tray 10b is lowered to refill the tray at which time the sensor 78b will cause an interrup through control line 80b at the CPU 38 and the current thickness value is cleared from memory location 74b. The thickness value sensed by sensor 24b of the first sheet fed from the tray 10b, after the tray 10b has been refilled and after the memory location 74b has been cleared, will be placed into the memory location 74b as the new thickness value for all of the remaining new sheets placed into tray 10b. The thickness value in memory location 74c will stay in memory location 74c until the tray 10c is lowered to refill the tray at which time the sensor 78c will cause an interrup through control line 80c at the CPU 38 and the current thickness value is cleared from memory location 74c. The thickness value sensed by sensor 24c of the first sheet fed from the tray 10c, after the tray 10c has been refilled and after the memory location 74c has been cleared, will be placed into the memory location 74c as the new thickness value for all of the remaining new sheets placed into tray 10c.

The thickness value sensed by sensor 24b for all subsequent sheets fed from tray 10b will be placed in memory location 76b and that value compared to the thickness value in memory location 74b. The thickness value sensed by sensor 24c for all subsequent sheets fed from tray 10c will be placed in memfory location 76c and that value compared to the thickness value in memory location 74c. The comparison will be done in the same manner as the comparison for the values of the subsequent sheets 12a that are fed from tray 10a.

Figure 4:
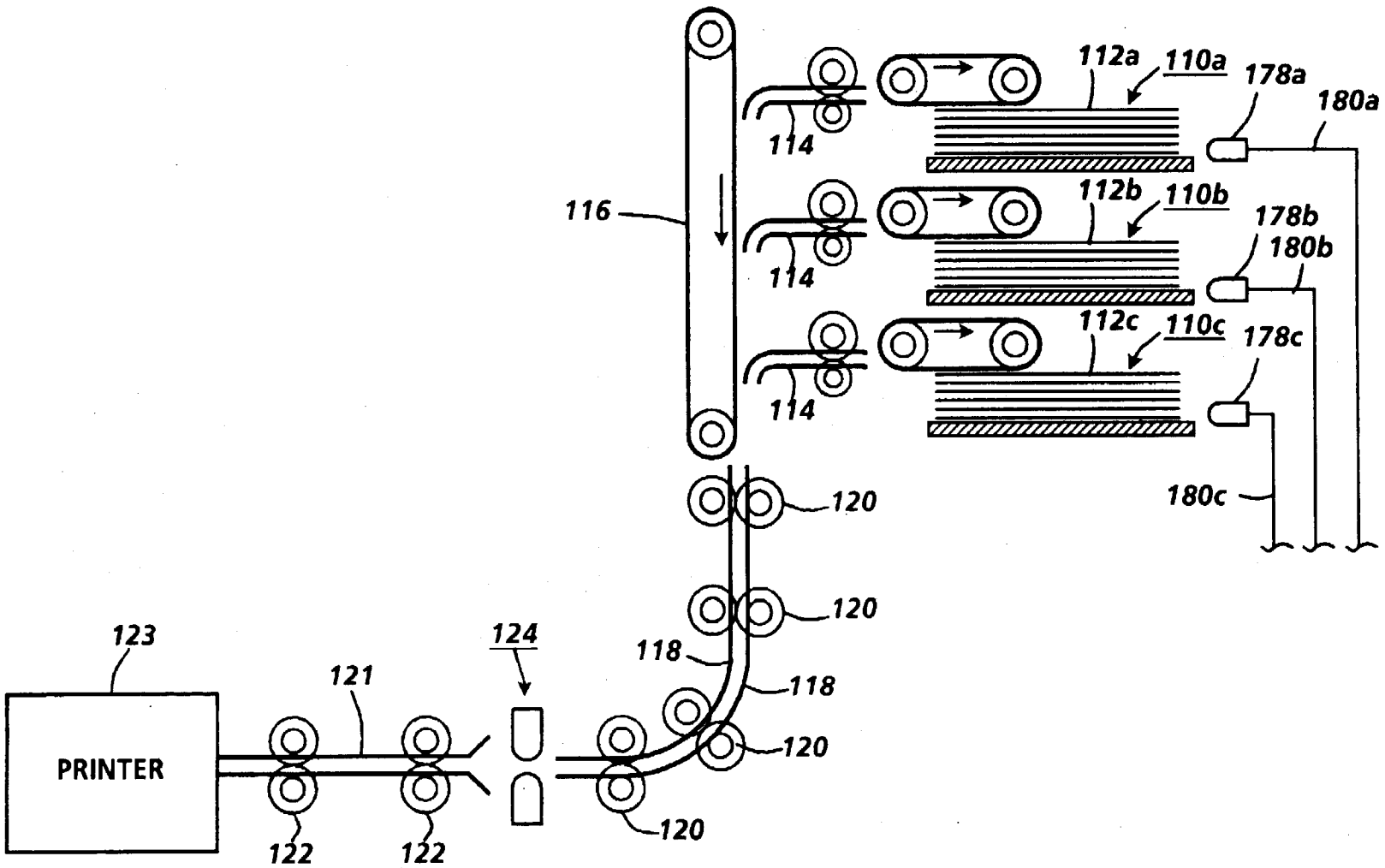
FIG. 4 is a schematic view of a printing system which includes a multi-sheet feed detector of a preferred embodiment of this invention.

Referring to FIG. 4, there is shown an alternative embodiment to the system disclosed in FIG. 1. In this embodiment, there is only one sheet thickness sensor which is placed at the end of the transport system from the three trays. While a misfeed will not be detected immediately as a sheet leaves a tray, this is a preferred embodiment since only one sensor is required and a misfeed detection can be tolerated as long as it is caught prior to entering a printer. The printing system comprises three trays 110a, 110b, and 110c, each having a plurality of sheets 112a, 112b, and 112c, respectively, stacked therein. The sheets in each tray are of the same thickness as the others in the same tray, but may be a different thickness than the sheets in the other trays. A sheet feeding apparatus 114 is provided for each feed tray and a common vacuum sheet transport belt conveyor 116 transports a sheet to guides 118 where a plurality of driven nip rolls 120 move a sheet through the guides 118 to guides 121 which have driven nip rolls 122 from which the sheets enter a laser printer 123 where an image is transferred to each sheet. A sensor 124 is located between the guides 118 and 121 for sensing the thickness of the sheets 112a, 112b and 112c as they are fed from their respective trays to the printer 123.

Figure 5:
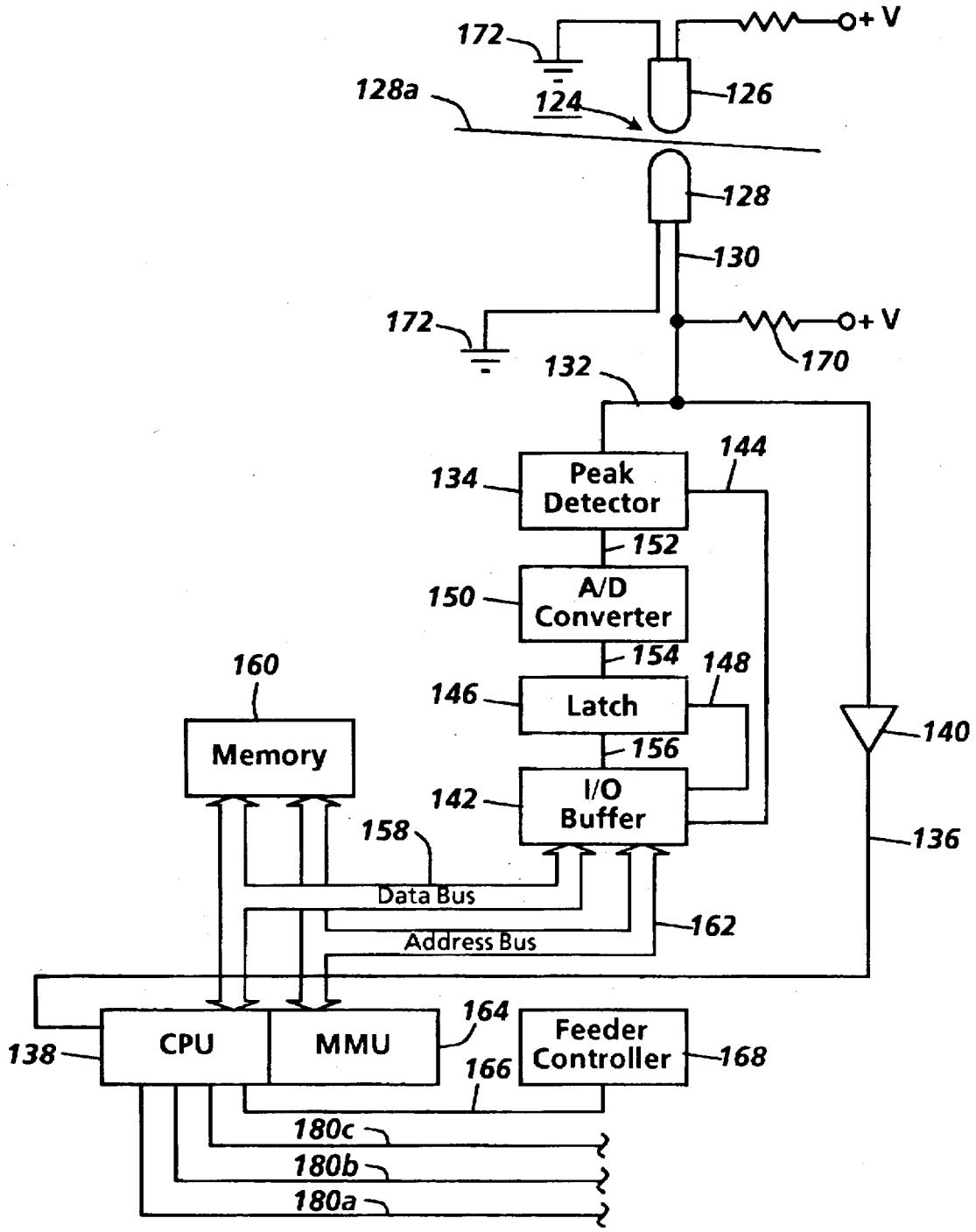
FIG. 5 is a block schematic diagram of the multi-sheet feed detector operating system illustrated in FIG. 4.

Referring to FIG. 5, there is shown a schematic of a sheet thickness sensing arrangement. The sensor 124 comprises an infrared emitter 126 and a phototransistor 128. The collector 130 of the phototransistor 128 is connected through a control line 132 to a peak detector 134 and through control line 136 to a CPU (central processing unit) 138. A positive transition detector 140 is located in control line 136 between the phototransistor 128 and the CPU 138 and detects sudden voltage changes at the collector 130. The peak detector 134 detects a peak voltage at collector 130 and is connected to an I/O (Input/output) buffer 142 through a control line 144 to allow the CPU to reset the peak detector to zero. A latch 146 is connected to the I/O buffer 142 through a control line 148 to allow the CPU to implement a data latch function. An A/D (analog/digital) converter 150 is connected to the peak detector 134 by line 152 and to the latch 146 by a 10 bit data line 154. A 10 bit data line 156 connects the latch 146 to the I/O buffer 142. A 16 bit data bus 158 links the CPU 138 with the I/O buffer 142 and memory 160. An address bus 162 links a MMU (memory management unit) 164 with the I/O buffers 142 and the memory 160.

The memory 160 is a two part memory having a RAM and an EPROM. The EPROM contains a program for controlling measurement and storage of thickness values of the sheets 112a, 112b, and 112c arriving at the sensors 124 from the trays 110a, 110b, and 110c and for comparison of the thickness values for detecting double sheet feed from each of the trays 110a, 110b, and 110c. The CPU 138 is connected through a control line 166 to a feeder controller 168 for controlling feeding of the sheets from the trays 110a, 110b and 110c.

As stated previously regarding the sensor 24, the amount of current that flows through the phototransistor 128 is a function of the amount of light to which a phototransistor is exposed. If the exposure to light is increased, more current will flow and if the exposure to light is decreased, less current will flow. There is maximum current flow across a resistor 170 when a sheet of paper is not between the emitter 126 and phototransistor 128 and the voltage difference between a ground 172 and the collector 130 of the phototransister 128 is at its lowest value in this condition. The voltage difference between ground 172 and the collector 130 will increase when a sheet passes between the emitter 126 and phototransistor 128 in accordance with an increase in the thickness of a sheet since the amount of light to which a phototransistor is exposed decreases as the thickness of a sheet sensed increases.

Figure 6:
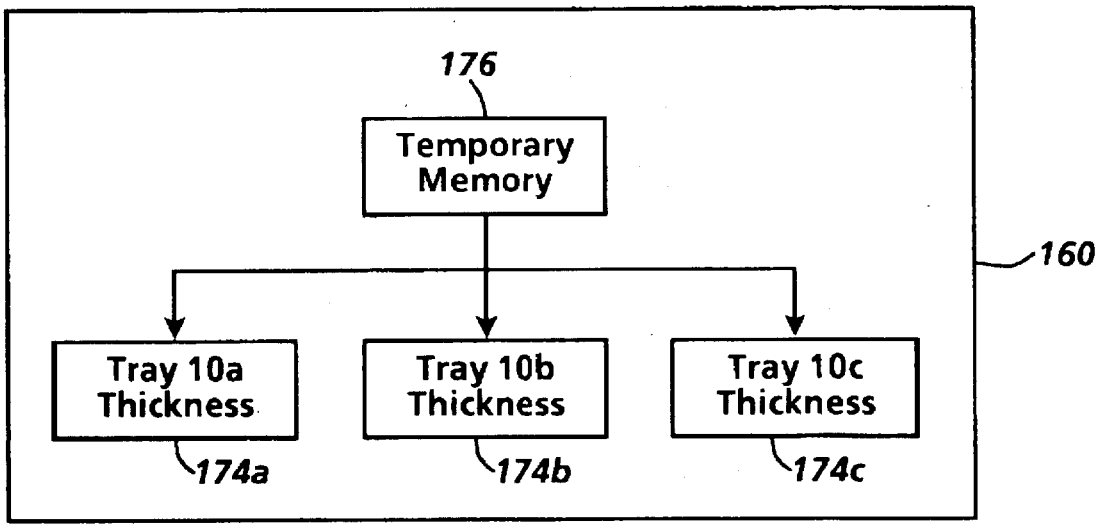
FIG. 6 is a block schematic diagram of a portion of a RAM memory of the schematic of FIG. 5.

The Ram section of the memory 160 is shown in FIG. 6. There are three memory locations 174a, 174b and 174c for the thickness value of the sheets in each tray 110a, 110b, and 110c, respectively. The sensed thickness value of the first sheet fed from a particular tray is put into these locations for the particular tray from which a first sheet is fed. There is also a temporary memory location 176 for the sensed thickness value of all other sheets fed from the trays.

Each tray 110a, 110b, and 110c has a sensor 178a, 178b, and 178c connected thereto for sensing when its respective tray has been lowered for refilling. The sensors 178a, 178b, and 178c are communicated to the CPU 38 by control lines 180a, 180b, and 180c, respectively. The sensor may be a contact switch, a push button switch or any other well know sensing device. When a tray is lowered, the sensor causes an interrup through a respective control line at the CPU 38. The CPU 38 is programmed to respond to the interrup to clear the memory for the tray that has been lowered and start the program for placing in the appropriate memory location for that tray the thickness value of the first sheet sensed that is fed from that tray after it is reloaded.

In operation, and referrring to only sheets being fed from tray 110a, when a sheet 112a is introduced into the sensor 124, there will be a sudden voltage change at the collector 130 which is sensed by the positive transition detector 140 which causes an interrupt through the control line 136 at CPU 138. The CPU is programmed to only respond to the initial interrupt and ignore any subsequent interrupts until after the sheet of paper has left the sensor 124. In response to the initial interrupt, the CPU, in conjunction with the MMU 164, addresses the I/O buffer 142 which immediately resets the peak detector 134. As in the previous embodiment, the voltage at collector 130 is sampledsix times as the sheet passes through the sensor 124.

The peak detector senses the voltage at collector 130 as the sheet passes between the emitter 126 and the phototransistor 128 with this voltage representing the thickness of the sheet. The voltage at the peak detector 134 is inputted to the A/D converter 150 in analog form and this is converted to digital form by the A/D converter 150 and sent to the latch 146. The first sensing will be completed by a first sampling taken 22 milliseconds after entry of the sheet into the sensor 124. The latch will be set at 22 milliseconds to capture the peak voltage in peak detector 34*a* and the peak detector reset immediately thereafter for detecting the voltage over the next 1.4 inches of the sheet. Some time between the expiration of the first 22 milliseconds and the expiration of the next 22 milliseconds, the I/O buffer 142 will send the voltage information for the first sampling of the sheet to the memory 160. The same cycle is repeated until after the sixth 1.4 inch section is sampled. When a new sheet is introduced into the sensor 124, the sudden voltage change at the collector 130 is sensed by the positive transition detector 140 which causes an interrupt at the CPU 38 and the same cycle is repeated for the new sheet.

After the sixth 1.4 inch section of a sheet 112 is sampled while the sheet passes through sensor 124, the six sampled values of the first sheet from the tray 110*a* is placed into memory location 174*a* as the thickness value for all of the remaining sheets in tray 110. The thickness value sensed for all subsequent sheets fed from tray 110*a* will be compared to the thickness value in memory location 174*a*. The thickness value in memory location 174*a* will stay in memory location 174*a* until the tray 110*a* is lowered to refill the tray at which time the sensor 178*a* will cause an interrup through control line 180*a* at the CPU 38 and the current thickness value is cleared from memory location 174*a*. The thickness value sensed by sensor 124 of the first sheet fed from the tray 110*a*, after the tray 10*a* has been refilled and after the memory location 174*a* has been cleared, will be placed into the memory location 174*a* as the new thickness value for all of the remaining new sheets placed into tray 10*a*.

When a subsequent sheet 112*a* is fed from the tray 110*a*, it is sensed by sensor 124 in the same manner as the first sheet was and after the sixth 1.4 inch section of a sheet 112*a* is sampled while the sheet passes through sensor 124, the six sampled values of the sheet is temporarily placed into memory location 176 and those values are compared with the six sampled values of the first sheet from the tray 110*a* that are in memory location 174*a*. This can be achieved by comparing the sum of the six sensed values in memory location 176 with the sum of the six sensed values in memory location 74*a*. If the sums are within a chosen tolerance of each other, it will be assumed that only one sheet has passed through the sensor 124 and normal operation of the printing system will continue. If the sum of the six sensed values, which is located in memory location 174*a*, for the first sheet is less than the sum of the six sensed values, located in memory location 176, of a subsequent sheet fed from tray 110*a* by more than a chosen tolerance, then such will indicate a greater sheet thickness for the subsequent sheet than the first sheet. Thus, it will be assumed that more than one sheet has passed through the sensor 124 and a signal will be sent by the CPU 38 over the control line 166 to the feeder controller 168 to immediately stop the sheet feeding system. A system operator can then remove the double fed sheets and reset the system to resume normal operation. Alternatively, in response to the signal, the offending sheets can be sent to a purge tray at the printer without stopping the sheet feeding system.

When a first sheet 112*b* and 112*c* is fed from trays 110*b* or 110*c*, the sheet will be sensed by sensor 124 in the same manner as the sheet 112*a* is sensed by sensor 124. The thickness value sensed by sensor 124 will be placed in the appropriate memory location 174*b* for tray 110*b*, as the thickness value for all of the remaining sheets in tray 110*b*, or in memory location 74*c* for tray 10*c* as the thickness value for all of the remaining sheets in tray 10*c*. The thickness value in memory location 174*b* will stay in memory location 174*b* until the tray 110*b* is lowered to refill the tray at which time the sensor 178*b* will cause an interrup through control line 180*b* at the CPU 38 and the current thickness value is cleared from memory location 174*b*. The thickness value sensed by sensor 124 of the first sheet fed from the tray 110*b*, after the tray 110*b* has been refilled and after the memory location 174*b* has been cleared, will be placed into the memory location 174*b* as the new thickness value for all of the remaining new sheets placed into tray 110*b*. The thickness value in memory location 174*c* will stay in memory location 174*c* until the tray 110*c* is lowered to refill the tray at which time the sensor 178*c* will cause an interrup through control line 180*c* at the CPU 38 and the current thickness value is cleared from memory location 174*c*. The thickness value sensed by sensor 124 of the first sheet fed from the tray 110*c*, after the tray 110*c* has been refilled and after the memory location 174*c* has been cleared, will be placed into the memory location 174*c* as the new thickness value for all of the remaining new sheets placed into tray 110*c*.

The thickness value sensed for all subsequent sheets fed from tray 110*b* will replace any thickness value in memory location 176 and that value will be compared to the thickness value in memory location 174*b*. The thickness value sensed for all subsequent sheets fed from tray 110*c* will replace any thickness value in memory location 176 and that value will be compared to the thickness value in memory location 174*c*. The comparison will be done in the same manner as the comparison for the values of the subsequent sheets 112*a* that are fed from tray 110*a*.

The CPU will keep track of the sheets as they are fed from a particular tray until after they pass through the sensor 124 so the sensed thickness values will be placed in the appropriate memory locations and the values corresponding to correct sheets and trays are compared.

Instead of comparing sums of values as described for both embodiments, each value sampled at the sensor 24*a*, 24*b*, 24*c* and 124 for the first sheet fed from a tray can be compared with each corresponding value sampled for a subsequent sheet fed from the same tray. If a certain number of values match within a given tolerance, it will be assumed that only one sheet passed through the sensors. For instance, if four of the six sensed values match, it will be assumed that only one sheet passed through the sensor. Obviously, other ways of comparing values can be used and the number of samplings can be changed to a particular situation desired. The comparison function can be conducted as a new sheet is fed from any tray into its respective sensor. This way, the system is not held up while a comparison is being made.

The detect system of the embodiment of FIG. 4 can also be used to detect a sheet which is being fed out of turn as well as double fed sheets. This is accomplished by having the CPU 138 send a signal at any time the values compared differ from one another above a chosen tolerance instead of only sending a signal when the value of a subsequent fed sheet is lower than the value of the first fed sheet from a tray above a chosen tolerance. Thus the system will catch a sheet that is not as thick as the sheet that is scheduled to enter the sensor 124. This can happen if a double sheet feed is missed.

It should be realized that sensors other than that disclosed can be used to sense the thickness of a sheet. For instance, a capacitance sensor can be used or a mechanical sensor could be used where movement of an arm in contact with a sheet passing beneath the arm would be translated into a sheet thickness value.

From the above, it can be seen that the system described will be able to ascertain a misfeed of sheets from a multi tray sheet feeder. Also, the system described can be applicable to a single tray feeder.

The system and the electronic components thereof have been described in general. It should be realized that well known programming techniques and off-the-shelf hardware are all that is required to achieve the principles of this invention. Thus someone with ordinary skill in the art will be able to construct the system described.

We claim:

1. In a sheet transport system comprising:

a. a first support tray for supporting a stack of sheets, b. a second support tray for supporting a stack of sheets, c. outlet guide means operably connected to said first and second support trays and located to receive sheets from each of said first and second support trays, d. an outlet sensor at said outlet guide means for sensing the thickness of each sheet passing through said outlet guide means, e. means for storing in memory the thickness value sensed by said outlet sensor of a first sheet discharged from each of said trays and passing through said outlet guide means, and e. means for comparing the thickness value sensed by said oulet sensor of subsequent sheets fed from each tray and passing through said outlet guide means with the thickness value stored in memory of the first sheet fed from the same tray and generating a signal indicating a misfeed if the values differ by a predetermined amount.

2. The apparatus as recited in claim 1 further comprising means for feeding sheets from each said trays to said outlet guide means, and means responsive to said signal for making inoperative said means for feeding sheets from each said trays to said outlet guide means.

3. The apparatus as recited in claim 2 wherein said outlet sensor comprises an infrared emitter located on one side of a sheet passing through the sensor and a phototransistor located on the opposite side of a sheet passing through said outlet sensor and arranged to receive rays emitted by said infrared emitter.

4. The apparatus as recited in claim 3, wherein said phototransistor has a collector referenced to ground and the sheet thickness value is sensed by said outlet sensor by detecting the potential between ground and said collector as a sheet passes between said infrared emitter and said phototransistor.

* * * * *